US010767462B2

(12) United States Patent
Ng et al.

(10) Patent No.: US 10,767,462 B2
(45) **Date of Patent: *Sep. 8, 2020**

(54) METHOD AND SYSTEM FOR PERFORMING AUTOMATED DRILLING OF A WELLBORE

(71) Applicant: Pason Systems Corp., Calgary (CA)

(72) Inventors: Choon-Sun James Ng, Calgary (CA); Sergey Khromov, Calgary (CA)

(73) Assignee: PASON SYSTEMS CORP., Calgary (CA)

( * ) Notice: Subject to any disclaimer, the term of this patent is extended or adjusted under 35 U.S.C. 154(b) by 37 days.

This patent is subject to a terminal disclaimer.

(21) Appl. No.: 16/251,402

(22) Filed: Jan. 18, 2019

(65) Prior Publication Data

US 2019/0153848 A1 May 23, 2019

Related U.S. Application Data

(63) Continuation of application No. 15/829,347, filed on Dec. 1, 2017, now Pat. No. 10,202,837.

(60) Provisional application No. 62/480,979, filed on Apr. 3, 2017.

(51) Int. Cl.
*E21B 44/02* (2006.01)
*E21B 45/00* (2006.01)

(52) U.S. Cl.
CPC ..... *E21B 44/02* (2013.01); *E21B 45/00* (2013.01)

(58) Field of Classification Search
CPC ..... E21B 44/02; E21B 45/00
See application file for complete search history.

(56) References Cited

U.S. PATENT DOCUMENTS

| | | | |
|---|---|---|---|
| 9,388,681 | B2 | 7/2016 | Dykstra et al. |
| 10,202,837 | B2 * | 2/2019 | Ng ..... E21B 44/02 |
| 2012/0118637 | A1 | 5/2012 | Wang et al. |
| 2014/0277752 | A1 | 9/2014 | Chang et al. |
| 2015/0240615 | A1 | 8/2015 | Dykstra et al. |

(Continued)

OTHER PUBLICATIONS

Notice of Allowance for Canadian Patent Application No. 2,987,662 dated Apr. 3, 2018.

(Continued)

*Primary Examiner* — D. Andrews
(74) *Attorney, Agent, or Firm* — Katten Muchin Rosenman LLP

(57) ABSTRACT

Methods, systems, and techniques for performing automated drilling of a wellbore. The wellbore is drilled in response to a first drilling parameter target (such as weight on bit) that includes a first drilling parameter offset modified by a first drilling parameter perturbation signal. A first drilling performance metric (such as rate of penetration) is measured and is indicative of a response of the drilling to the first drilling parameter target. An output of a first objective function is determined using the measured first drilling performance metric. A first correlation between the output of the first objective function and the first drilling parameter perturbation signal, and an integral of the first correlation, are determined. The first drilling parameter target is updated using the integral modified by the first drilling parameter perturbation signal. The wellbore is drilled in response to the updated first drilling parameter target.

20 Claims, 10 Drawing Sheets

(56) References Cited

U.S. PATENT DOCUMENTS

| | | | |
|---|---|---|---|
| 2016/0168973 | A1 | 6/2016 | Dykstra et al. |
| 2017/0002641 | A1 | 1/2017 | Dykstra et al. |

OTHER PUBLICATIONS

Mar. 13, 2018 Response to Official Action for Canadian Patent Application No. 2,987,662.
Feb. 20, 2018 Official Action for Canadian Patent Application No. 2,987,662.
Tan et al., Extremum Seeking From 1922 to 2010, Proceedings of the 29th Chinese Control Conference, Jul. 29-31, 2010, Beijing, China.
The Pason AutoDriller—Optimal Drilling Control and Accuracy. Last Accessed Jan. 18, 2017 from <https://pason.com/images/Product_Application_Notes/docu214_en_autodriller_product_application_note.pdf>.
Krstić, Miroslav, and Hsin-Hsiung Wang, "Stability of extremum seeking feedback for general nonlinear dynamic systems." Automatica 36 (2000): 595-601.
Ariyur, Kartik B., and Miroslav Krstic, Real-time optimization by extremum-seeking control, John Wiley & Sons, 2003.
Krstić, Miroslav, "Performance improvement and limitations in extremum seeking control." Systems & Control Letters 39.5 (2000): 313-326.
Tan, Ying, Dragan Nešić, and Iven Mareels. "On the choice of dither in extremum seeking systems: A case study." Automatica 44.5 (2008): 1446-1450.
Office Action for Canadian Patent Application No. 2,987,662 dated Feb. 20, 2018.
Examination Search Report for Canadian Patent Application No. 2,987,662 with a search report dated Feb. 19, 2018.

* cited by examiner

METHOD AND SYSTEM FOR PERFORMING AUTOMATED DRILLING OF A WELLBORE

This application is a continuation of U.S. patent application Ser. No. 15/829,347, filed Dec. 1, 2017, which issued as U.S. Pat. No. 10,202,837 and which claims priority to U.S. Patent Appln. No. 62/480,979, filed Apr. 3, 2017, the contents of all of which are incorporated herewith.

TECHNICAL FIELD

The present disclosure is directed at a method and system for performing automated drilling of a wellbore.

BACKGROUND

Oil and gas wellbore drilling may be partially or entirely automated. For example, certain example automated drilling units may attempt to maximize rate of penetration by varying weight on bit in response to one or more measured drilling parameters. Examples of those drilling parameters may comprise any one or more of readings from hookload, depth, and drilling fluid pressure sensors. Those units are designed to increase drilling efficiency by, for example, extending drill bit life and reducing total drilling hours.

SUMMARY

According to a first aspect, there is provided a method for performing automated drilling of a wellbore, the method comprising drilling the wellbore in response to a first drilling parameter target, wherein the first drilling parameter target comprises a first drilling parameter offset modified by a first drilling parameter perturbation signal; measuring a first drilling performance metric to determine a measured first drilling performance metric, wherein the first drilling performance metric is indicative of a response of the drilling to the first drilling parameter target; determining an output of a first objective function using the measured first drilling performance metric; determining a first correlation between the output of the first objective function and the first drilling parameter perturbation signal; determining an integral of the first correlation; updating the first drilling parameter target using the integral of the first correlation modified by the first drilling parameter perturbation signal; and after the first drilling parameter target has been updated, drilling the wellbore in response to the first drilling parameter target.

The actions of drilling the wellbore in response to the first drilling parameter target through to after the first drilling parameter target has been updated may be iteratively performed at a sampling frequency used to measure the first drilling performance metric.

Determining the first correlation may comprise measuring the response of the automated drilling to the first drilling parameter target to determine a measured first drilling parameter; determining a first drilling parameter perturbation signal delay from a correlation between the first drilling parameter perturbation signal and the measured first drilling parameter; and delaying the first drilling parameter perturbation signal by the first drilling parameter perturbation signal delay prior to using the first drilling parameter perturbation signal to determine the first correlation.

The first correlation may be normalized to be between [−1,1].

The method may further comprise drilling the wellbore in response to a second drilling parameter target, wherein the second drilling parameter target comprises a second drilling parameter offset modified by a second drilling parameter perturbation signal; measuring a second drilling performance metric to determine a measured second drilling performance metric, wherein the second drilling performance metric is indicative of a response of the drilling to the second drilling parameter target; determining an output of a second objective function using the second drilling performance metric; determining a second correlation between the output of the second objective function and the second drilling parameter perturbation signal; determining an integral of the second correlation; updating the second drilling parameter target using the integral of the second correlation modified by the second drilling parameter perturbation signal; and after the second drilling parameter target has been updated, drilling the wellbore in response to the second drilling parameter target.

The actions of drilling the wellbore in response to the second drilling parameter target through to after the second drilling parameter target has been updated may be iteratively performed at a sampling frequency used to measure the second drilling performance metric.

Determining the second correlation may comprise measuring the response of the automated drilling to the second drilling parameter target to determine a measured second drilling parameter; determining a second drilling parameter perturbation signal delay from a correlation between the second drilling parameter perturbation signal and the measured second drilling parameter; and delaying the second drilling parameter perturbation signal by the second drilling parameter perturbation signal delay prior to using the second drilling parameter perturbation signal to determine the second correlation.

The second correlation may be normalized to be between [−1,1].

The first drilling performance metric may be rate of penetration, mechanical specific energy, or stick-slip severity, and the second drilling performance metric may be rate of penetration, mechanical specific energy, or stick-slip severity.

The first and second objective functions may be identical.

Each of the first and second drilling parameter perturbation signals may be sinusoidal.

The first and second drilling parameter perturbation signals may have different frequencies.

Updating the first drilling parameter target using the integral of the first correlation may comprise applying a limit check to the integral of the first correlation; when the integral of the first correlation is less than a minimum first parameter limit, updating the first drilling parameter target using the minimum first parameter limit; and when the integral of the first correlation exceeds a maximum first parameter limit, updating the first drilling parameter target using the maximum first parameter limit.

Updating the second drilling parameter target using the integral of the second correlation may comprise applying a limit check to the integral of the second correlation; when the integral of the second correlation is less than a minimum second parameter limit, updating the second drilling parameter target using the minimum second parameter limit; and when the integral of the second correlation exceeds a maximum second parameter limit, updating the second drilling parameter target using the maximum second parameter limit.

The first drilling parameter target may be a weight-on-bit target and the second drilling parameter target may be a rotation rate target.

The second drilling parameter perturbation signal may have a frequency twice that of the first drilling parameter perturbation signal.

Each of the first and second drilling performance metrics may be rate of penetration and the method may further comprise, prior to determining the second correlation, removing from the measured second drilling performance metric a portion of the rate of penetration attributed to stretching and compression of a drill string used to drill the wellbore.

The measured first drilling parameter may comprise a non-linear and delayed response to the first drilling parameter target, and the method may further comprise determining the portion of the measured second drilling performance metric attributed to stretching and compression of the drill string from the measured first drilling parameter and the measured second drilling performance metric.

The first drilling parameter perturbation signal may be sin(ωt), the second drilling parameter perturbation signal may be sin(2ωt), and the portion of the measured second drilling performance metric attributed to stretching and compression of the drill string may be determined as $$2kS_{W2}\cos(2\omega t)-2kC_{W2}\sin(2\omega t),$$

wherein $$k = \frac{\mathrm{corr}(ROP_{measured}, \cos(\omega(t-d)))}{\mathrm{corr}(WOB_{actual}, \sin(\omega(t-d)))},$$

$$S_{W2} = \frac{2}{N}\mathrm{corr}(WOB_{actual}, \sin(2\omega t)),$$

$$C_{W2} = \frac{2}{N}\mathrm{corr}(WOB_{actual}, \cos(2\omega t)),\ N = TF_s,$$

ω is the angular frequency of the first drilling parameter perturbation signal, $$T = \frac{2\pi}{\omega},$$

$F_s$ is a sampling frequency used to obtain the measured first and second drilling parameters, d is the first drilling parameter perturbation signal delay, $ROP_{measured}$ is measured rate of penetration, and $WOB_{actual}$ is measured weight on bit, and corr($WOB_{actual}$, cos(2ωt)) is a dot-product of $WOB_{actual}$ and cos(2ωt).

One or both of the first and second objective functions may be $$J = \frac{ROP^c}{T^a N^b},$$

wherein J is the output of the first and second objective functions, ROP is the rate of penetration, T is torque applied to the drill string, and N is revolutions per minute of the drill bit.

One or both of the first and second objective functions may be $$J = \frac{ROP^c}{WOB^a N^b},$$

wherein J is the output of the first objective function, ROP is the rate of penetration, WOB is weight-on-bit, and N is revolutions per minute of the drill bit.

One or both of the first and second objective functions may be $$J = \frac{ROP^c}{DIFP^a N^b},$$

wherein J is the output of the first objective function, ROP is the rate of penetration, DIFP is differential pressure, and N is revolutions per minute of the drill bit.

According to another aspect, there is provided a system for performing automated drilling of a wellbore, the system comprising a height control apparatus configured to adjust a height of a drill string used to drill the wellbore; a height sensor; a rotational drive unit comprising a rotational drive unit controller and a rotation rate sensor; a depth sensor; a hookload sensor; a drilling controller communicatively coupled to the rotational drive unit controller, the rotation rate sensor, the height control apparatus, the height sensor, the depth sensor, and the hookload sensor, the drilling controller configured to perform any of the foregoing aspects of the method and suitable combinations and variations thereof.

The drilling controller may comprise a rotational drive controller communicatively coupled to the rotational drive unit controller and rotation rate sensor; an automated drilling unit communicatively coupled to the height control apparatus, the height sensor, the depth sensor, and the hookload sensor; and a processor communicatively coupled to the rotational drive controller and automated drilling unit and configured to perform any of the foregoing aspects of the method and suitable combinations and variations thereof.

The system may further comprise a standpipe pressure sensor and a torque sensor, each communicatively coupled to the drilling controller.

According to another aspect, there is provided a non-transitory computer readable medium having stored thereon program code that is executable by a processor and that, when executed, causes the processor to perform any of the foregoing aspects of the method and suitable combinations and variations thereof.

This summary does not necessarily describe the entire scope of all aspects. Other aspects, features and advantages will be apparent to those of ordinary skill in the art upon review of the following description of specific embodiments.

BRIEF DESCRIPTION OF THE DRAWINGS

In the accompanying drawings, which illustrate one or more example embodiments.

DETAILED DESCRIPTION

In a conventional automated drilling system, an automated drilling unit varies a drilling parameter in order to adjust the rate of penetration ("ROP") of a drill bit through a formation. The automated drilling system uses a stepped input signal to change the magnitude of the drilling parameter and waits until the response of the drilling rig sufficiently settles before averaging that response. In view of the response, the automated drilling system again changes the drilling parameter. Drilling in this manner is laborious and relatively inefficient.

The embodiments described herein are directed at methods, systems, and techniques in which a processor modifies an input signal used to control drilling using a perturbation signal. The input signal represents a drilling parameter such as block velocity, weight on bit ("WOB"), surface revolutions per minute ("RPM"), bit RPM, and differential pressure across a mud motor. The real time input and response, as represented by output measurements, of the drilling rig while drilling the wellbore are used to evaluate an objective function. The output of the objective function is correlated with a delayed version of the perturbation signal to determine the next input signal to be used to control drilling. This process effectively performs extremum seeking on the objective function that a driller wishes to maximize or minimize. The objective function comprises a drilling performance metric, such as ROP, drilling efficiency, bit wear, or depth of cut (ROP/RPM), which is indicative of how well drilling is progressing. In at least some example embodiments, a drilling performance metric is a subset of a drilling parameter, with drilling parameters that do not qualify as drilling performance metrics being parameters that are not indicative of how well drilling is progressing. This process is iterative, and in certain embodiments, is discrete in time and performed at the rate at which the drilling parameter is sampled. In certain embodiments, one or both of multiple drilling parameters and multiple drilling performance metrics may be used to seek the objective function's extremum.

Figure 1:
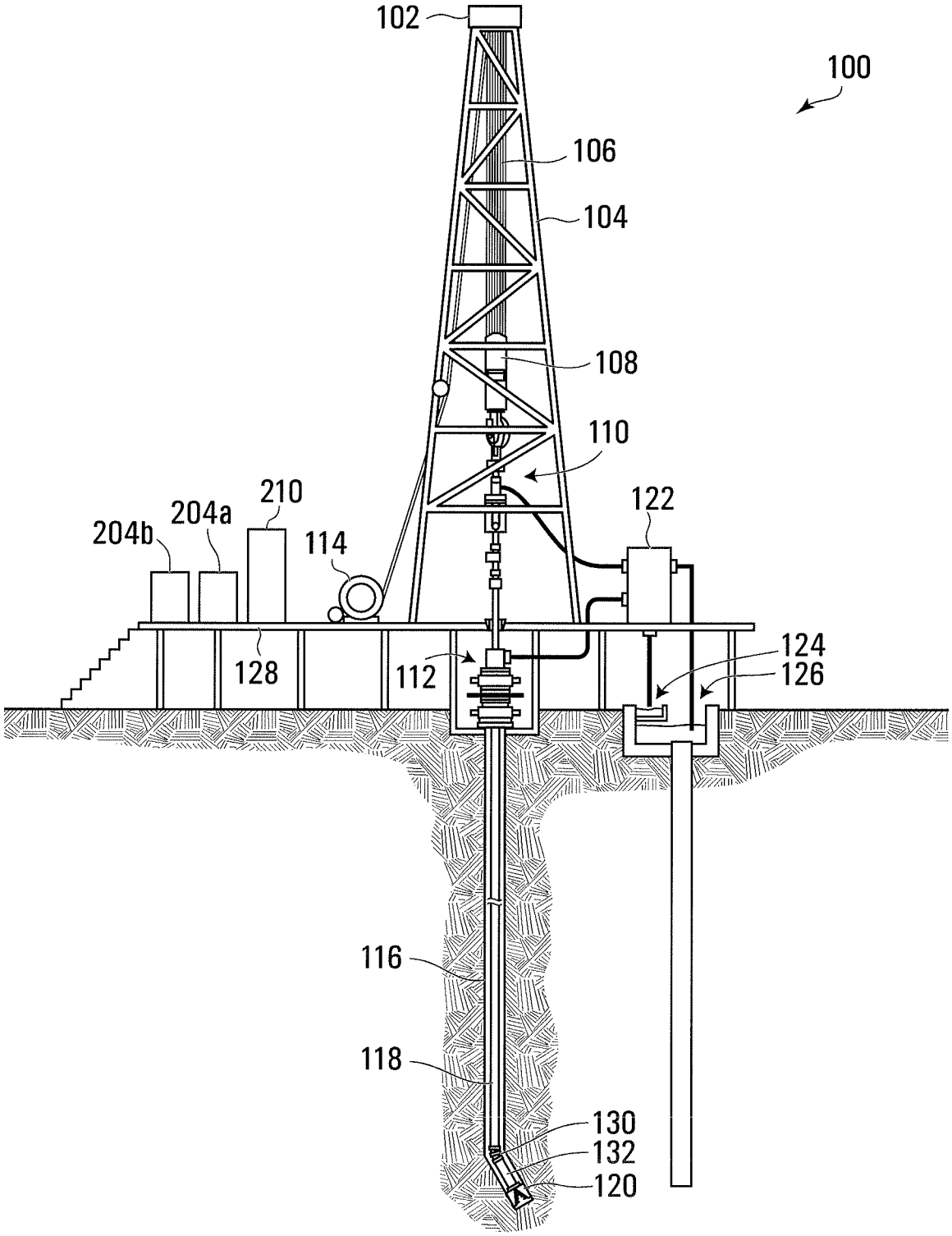
FIG. 1 is a schematic of a drilling rig, according to one embodiment.

FIG. 1 shows a drilling rig 100, according to one embodiment. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a traveling block 108 via a crown block 102. The traveling block 108 is connected to the drill string 118 via a top drive 110. Rotating the drawworks 114 consequently is able to change WOB during drilling, with rotation in one direction lifting the traveling block 108 and generally reducing WOB and rotation in the opposite direction lowering the traveling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126.

Figure 2:
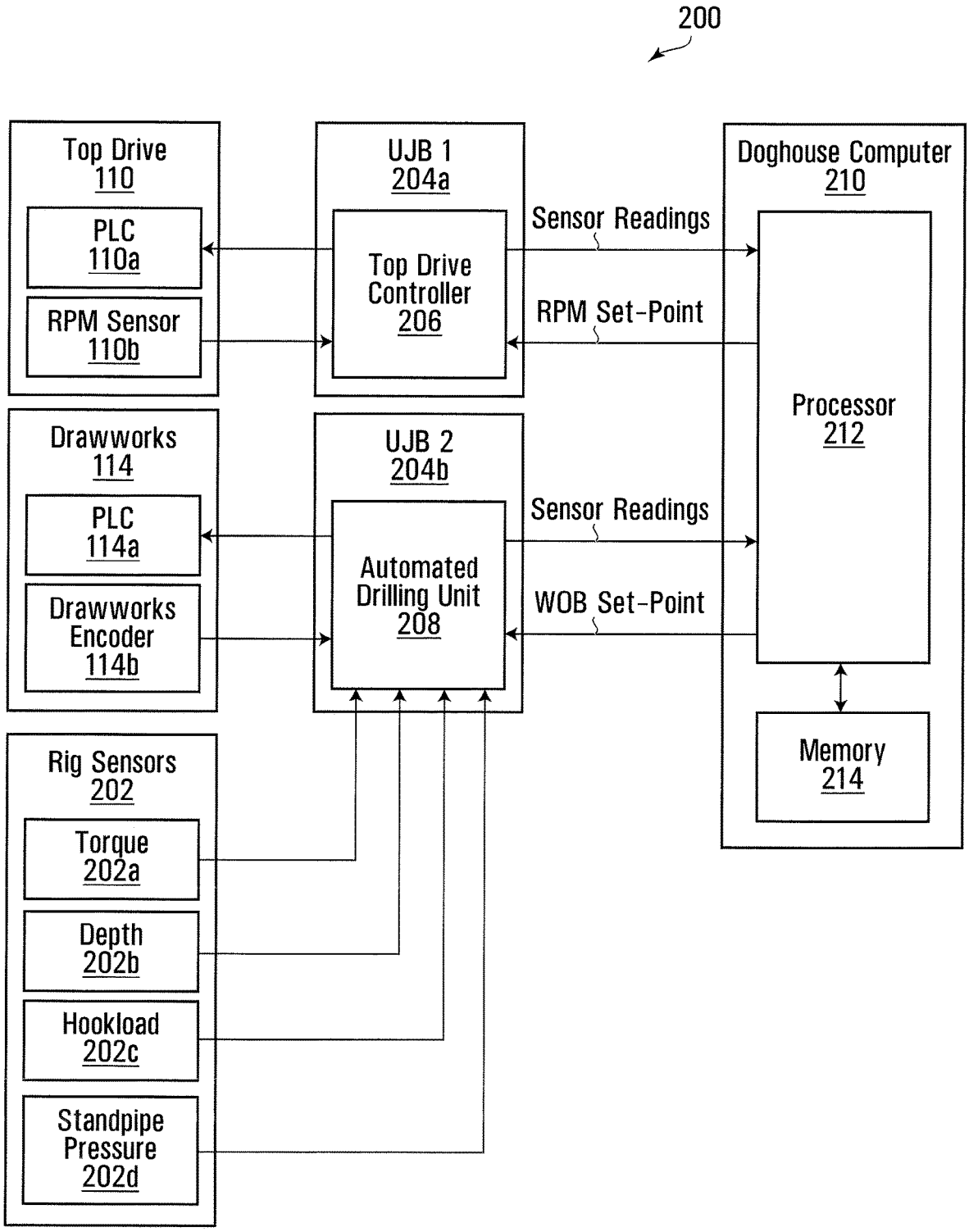
FIG. 2 is a block diagram of a system for performing automated drilling of a wellbore, according to the embodiment of FIG. 1.

FIG. 2 shows a block diagram of a system 200 for performing automated drilling of a wellbore, according to the embodiment of FIG. 1. The system 200 comprises various rig sensors: a torque sensor 202*a*, depth sensor 202*b*, hookload sensor 202*c*, and standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the traveling block 108. The top drive 110 comprises a top drive programmable logic controller ("top drive PLC") 110*a* that controls the top drive's 114 rotation and an RPM sensor 110*b* that outputs the rotational rate of the drill string 118. More generally, the top drive PLC 110*a* is an example of a rotational drive unit controller and the RPM sensor 110*b* is an example of a rotation rate sensor.

A first junction box 204*a* houses a top drive controller 206, which is communicatively coupled to the top drive PLC 110*a* and the RPM sensor 110*b*. The top drive controller 206 controls the rotation rate of the drill string 118 by instructing the top drive PLC 110*a* and obtains the rotation rate of the drill string 118 from the RPM sensor 110*b*.

A second junction box 204*b* houses an automated drilling unit 208, which is communicatively coupled to the drawworks PLC 114*a* and the drawworks encoder 114*b*. The automated drilling unit 208 modulates WOB during drilling by instructing the drawworks PLC 114*a* and obtains the height of the traveling block 108 from the drawworks encoder 114*b*. In different embodiments, the height of the traveling block 108 can be obtained digitally from rig instrumentation, such as directly from the PLC 114*a* in digital form. In different embodiments (not depicted), the junction boxes 204*a*, 204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the ROP of the drill bit 120 by monitoring the height of the traveling block 108 over time.

The system 200 also comprises a doghouse computer 210. The doghouse computer 210 comprises a processor 212 and memory 214 communicatively coupled to each other. The memory 214 stores on it computer program code that is executable by the processor 212 and that, when executed, causes the processor 212 to perform a method 500 for performing automated drilling of the wellbore 116, such as that depicted in FIG. 5. The processor 212 receives readings from the RPM sensor 110*b*, drawworks encoder 114*b*, and the rig sensors 202, and sends an RPM target and a WOB target to the top drive controller 206 and automated drilling unit 208, respectively. The top drive controller 206 and automated drilling unit 208 relay these targets to the top drive PLC 110*a* and drawworks PLC 114*a*, respectively, where they are used for automated drilling. More generally, the RPM target is an example of a rotation rate target.

Each of the first and second junction boxes may comprise a Pason Universal Junction Box™ (UJB) manufactured by Pason Systems Corp. of Calgary, Alberta. The automated drilling unit 208 may be a Pason Autodriller™ manufactured by Pason Systems Corp. of Calgary, Alberta.

The top drive controller 110, automated drilling unit 208, and doghouse computer 210 collectively comprise an example type of drilling controller. In different embodiments, however, the drilling controller may comprise different components connected in different configurations. For example, in the system 200 of FIG. 2, the top drive controller 110 and the automated drilling unit 208 are distinct and respectively use the RPM target and WOB target for automated drilling. However, in different embodiments (not depicted), the functionality of the top drive controller 206 and automated drilling unit 208 may be combined or may be divided between three or more controllers. In certain embodiments (not depicted), the processor 212 may directly communicate with any one or more of the top drive 110, drawworks 114, and sensors 202. Additionally or alternatively, in different embodiments (not depicted) automated drilling may be done in response to only the RPM target, only the WOB target, one or both of the RPM and WOB targets in combination with additional drilling parameters, or targets based on drilling parameters other than RPM and WOB. Examples of these additional drilling parameters comprise differential pressure, an ROP target, depth of cut, torque, and flow rate (into the wellbore 116, out of the wellbore 116, or both).

In the depicted embodiments, the top drive controller 110 and the automated drilling unit 208 acquire data from the sensors 202 discretely in time at a sampling frequency $F_s$, and this is also the rate at which the doghouse computer 210 acquires the sampled data. Accordingly, for a given period T, N samples are acquired with $N=TF_s$. In different embodiments (not depicted), the doghouse computer 210 may receive the data at a different rate than that at which it is sampled from the sensors 202. Additionally or alternatively, the top drive controller 110 and the automated drilling unit 208 may sample data at different rates, and more generally in embodiments in which different equipment is used data may be sampled from different sensors 202 at different rates.

Figure 3:
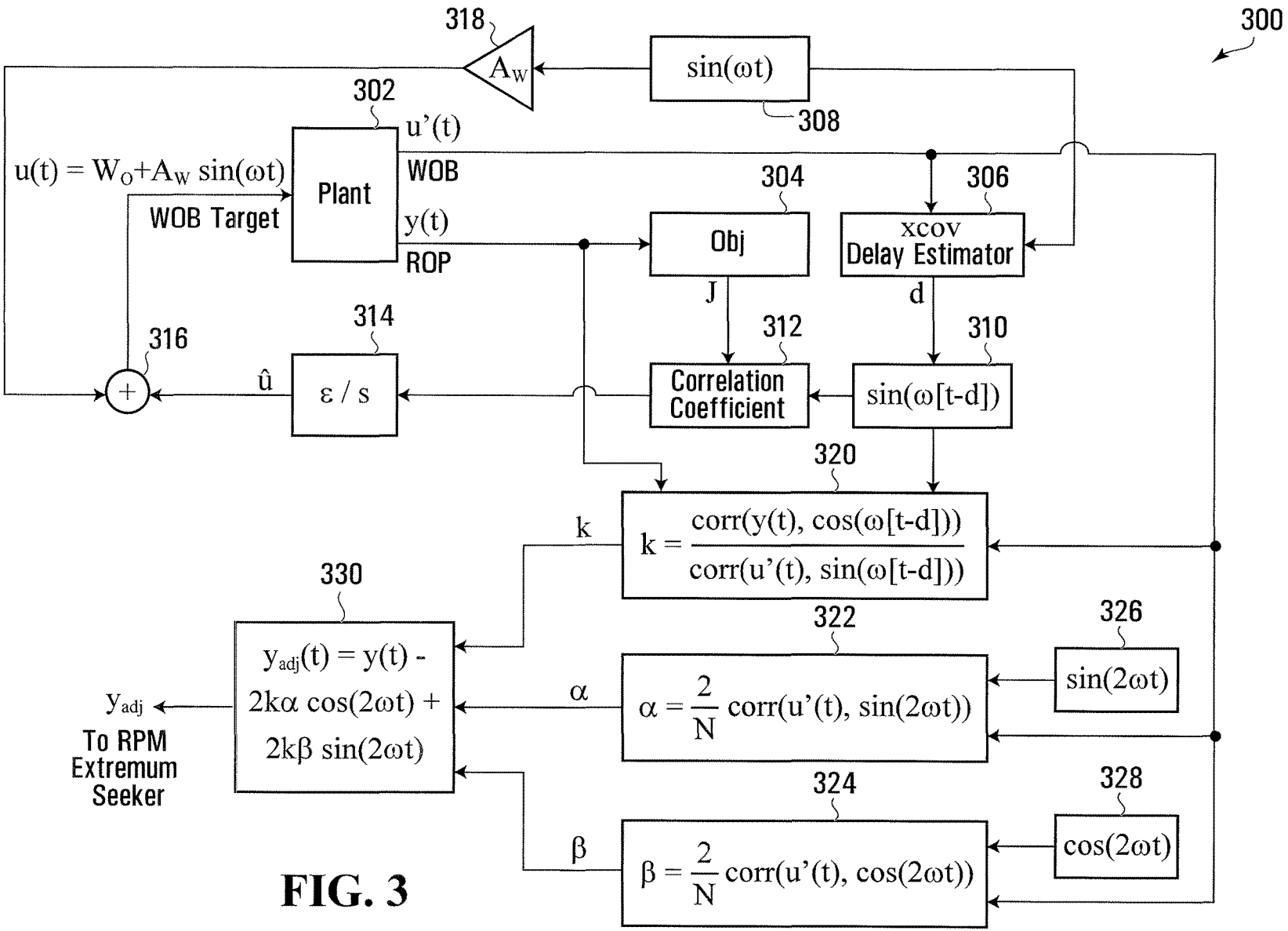
FIG. 3 is a block diagram of a system for seeking an objective function extremum based on weight on bit ("WOB"), according to the embodiment of FIG. 1.

Referring now to FIG. 3, there is shown a block diagram of a system 300 for seeking an objective function extremum based on WOB, which is expressed in the computer program code stored in the memory 214 and performed by the processor 212 when that code is executed. The system 300 of FIG. 3 attempts to maximize the objective function by drilling in response to an initial WOB target that comprises a time varying WOB perturbation signal, observing how drilling is performed in response to that initial target, and then updating the WOB target in view of that observed response and drilling using that updated target. And in FIG. 4, there is shown a block diagram of a system 400 for seeking an objective function extremum based on RPM, which is also expressed in the computer program code stored in the memory 214 and performed by the processor 212 when that code is executed. The system 400 of FIG. 4 attempts to maximize the objective function by drilling in response to an initial RPM target that comprises a time varying RPM perturbation signal, and then updating the RPM target in view of that observed response and drilling using that updated target. The processor 212 runs the systems 300, 400 concurrently; however, in different embodiments (not depicted), the processor 212 may alternate operation of the systems 300, 400 such that the processor 212 switches between maximizing the objective function in response to WOB using the system 300 of FIG. 3 and maximizing the objective function in response to RPM using the system 400 of FIG. 4. Different configurations are also possible. For example, in different embodiments (not depicted), the systems 300, 400 may be replaced with one or more systems each of which uses as inputs multiple drilling parameters (e.g., the systems 300, 400 may be replaced with a single system that uses both WOB and RPM as inputs, with the processor 212 modulating those inputs concurrently).

Figure 10A:
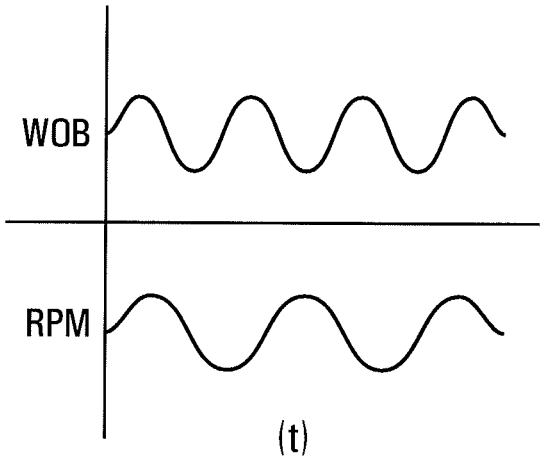
FIGS. 10A-10E depict how WOB and RPM may be modulated as inputs to the systems of FIGS. 3 and 4, respectively, according to additional example embodiments.
Figure 10D:
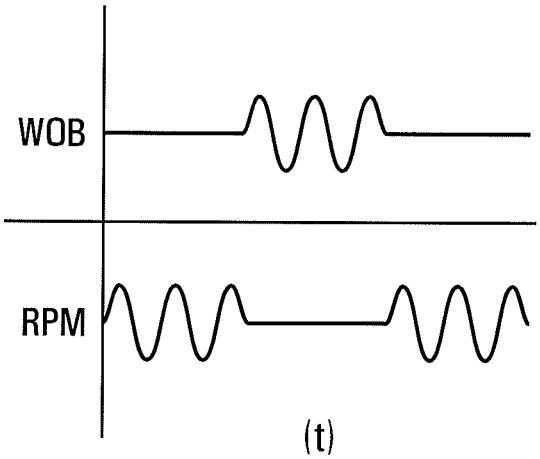
Figure 10B:
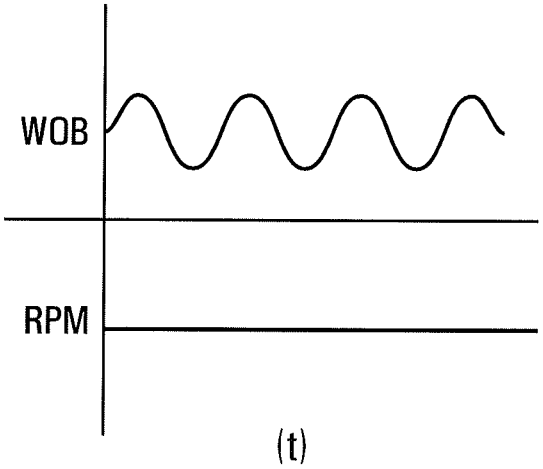
Figure 10E:
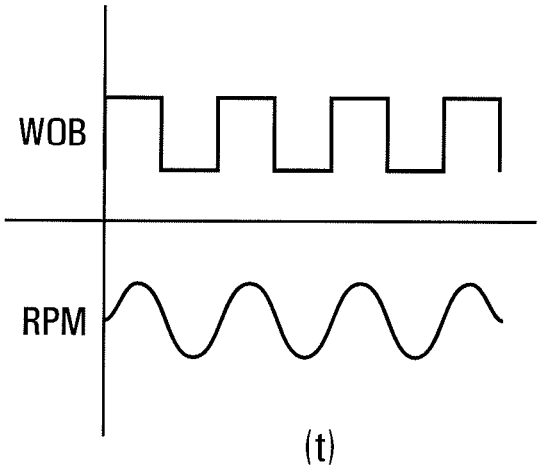
Figure 10C:
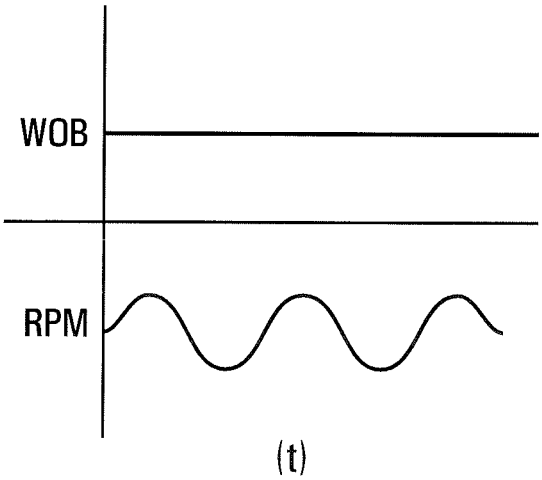

FIGS. 10A-10E show different ways in which the processor 212 may modulate the WOB and RPM inputs of the systems 300, 400. In FIG. 10A, the processor 212 modulates the WOB and RPM inputs of the systems 300, 400 concurrently. In another embodiment as shown in FIG. 10B, the processor 212 modulates the WOB input of the system 300 of FIG. 3 while holding the RPM input to the system 400 of FIG. 4 generally constant. In FIG. 10B, processor 212 may continue to evaluate the output of the system 400 of FIG. 4 without modifying its RPM input. In another embodiment shown in FIG. 10C, the processor 212 modulates the RPM input of the system 400 of FIG. 4 while holding the WOB input to the system 300 of FIG. 3 generally constant. In FIG. 10C, the processor 212 may continue to evaluate the output of the system 300 of FIG. 3 without modifying its WOB input. In another embodiment shown in FIG. 10D, the processor 212 evaluates the different systems 300, 400 and modulates either WOB or RPM depending on a priority selecting method. The priority selecting method may select either of the systems 300, 400 to be the controlling system based on time, depth, mechanical specific energy ("MSE"), or another suitable drilling parameter. In another example embodiment as depicted in FIG. 10E, one or more of the input signals input to the systems 300, 400 can be non-sinusoidal and periodic.

In certain embodiments, drilling in this manner may result in one or more technical benefits. For example, concurrently attempting to maximize the objective function in view of multiple inputs, such as WOB and RPM, may help to increase the rate at which the objective function extremum is approached. Additionally, drilling in this manner is an iterative process, which may help the system adapt to changes such as changes in drilling environment characteristics and consequent changes in the objective function extremum. Drilling in this manner may also be relatively robust. Furthermore, drilling in this manner does not require a priori knowledge of models of the plants 302, 402, which may be beneficial in that those models may be of non-linear or time-varying processes that are difficult to accurately model.

Examples of extremum seeking are discussed in more detail in Y. Tan, W. H. Moase, C. Manzie, D. Nešić, and I. M. Y. Mareels, *Extremum Seeking From* 1922 *to* 2010, Proceedings of the 29th Chinese Control Conference, July 29-31 in Beijing, China; Krstić, Miroslav, and Hsin-Hsiung Wang, "Stability of extremum seeking feedback for general nonlinear dynamic systems." *Automatica* 36.4 (2000): 595-601; Ariyur, Kartik B., and Miroslav Krstic, *Real-time optimization by extremum-seeking control*, John Wiley & Sons, 2003; and Krstić, Miroslav, "Performance improvement and limitations in extremum seeking control." *Systems & Control Letters* 39.5 (2000): 313-326, the entireties of all of which are hereby incorporated by reference herein.

The system 300 of FIG. 3 comprises a plant 302 with an unknown response. The plant 302 represents the automated drilling unit 208, sensors 202, and drilling rig 100. The processor 212 sends the WOB target (u(t)) to the plant 302, and in response the plant 302 outputs the WOB as measured by the hookload sensor 202*c* ("measured WOB") (u'(t)) and the ROP as measured using the drawworks encoder 114*b* (y(t)) to the processor 212. As used herein, a "measured" drilling parameter, examples of which comprise WOB and ROP, refers to a drilling parameter that has been directly or indirectly measured. For example, "measured MSE" in certain example embodiments may not be directly measured but instead indirectly measured by being determined from measurements of WOB, torque, ROP, and RPM. More generally, an indirectly measured drilling parameter comprises a drilling parameter determined using one or more direct measurements.

The WOB target that the processor 212 sends to the plant 302 has the form of Equation (1):

$$u(t)=W_o+A_W\sin(\omega t) \tag{1}$$

where $W_o$ is a WOB offset and $A_W\sin(\omega t)$ is a WOB perturbation signal having a perturbation amplitude $A_W$ and angular frequency ω.

Blocks 302-318 in the system 300 of FIG. 3 perform extremum seeking based on the WOB target. More particularly, the processor 212 generates the WOB perturbation signal at blocks 308 and 318, and the WOB perturbation signal is added to the WOB offset at an adder 316 to generate the WOB target. Generating the WOB offset is discussed in further detail below. The WOB target is then sent to the plant 302.

The plant 302 receives the WOB target from the processor 212, from which the processor 212 obtains the measured WOB and ROP using the hookload sensor 202*c* and drawworks encoder 114*b*, respectively. The measured WOB and ROP values are suitably conditioned by, for example, amplification and filtering prior to being used elsewhere in the system 300. The processor 212 uses the measured WOB and ROP to evaluate an objective function 304.

The processor 212 attempts to find an extremum of the objective function 304. In the depicted embodiment, the objective function 304 is as shown in Equation (1.1):

$$J=\frac{ROP^c}{T^aN^b} \tag{1.1}$$

where J is the output of the objective function, T is torque, N is drill bit RPM, and a, b, and c are exponents that determine the trade-off between drilling rate and energy expenditure. N may be measured RPM is certain example embodiments; in different example embodiments, N may be estimated. For example, N may be bit RPM estimated using flow rate measured at the surface and a specified and known mud motor speed-to-flow rate ratio in embodiments in which a mud motor is used and the mud motor speed-to-flow rate ratio is known.

In the depicted embodiment, a=1, b=1, and c=2. However, in different embodiments (not depicted), any one or more of these exponents may be selected differently. For example, in one non-depicted embodiment, a=b=0 and c=1, in which case the system 300 attempts to find the ROP extremum. The exponents a, b, and c may be determined empirically. The objective function's 304 output J is sent to a correlation coefficient block 312.

Generally, in at least some example embodiments, the objective function 304 is generally of the form ROP/Energy, with the product of torque and RPM in Equation (1.1) representing energy. In one example embodiment, the objective function 304 is as shown in Equation (1.2):

$$J=\frac{ROP^c}{WOB^aN^b} \tag{1.2}$$

In another example embodiment, the objective function 304 is as shown in Equation (1.3):

$$J=\frac{ROP^c}{DIFP^aN^b} \tag{1.3}$$

where DIFP is measured differential pressure. In Equations (1.1)-(1.3), the denominators generally relate to energy input to the rig 100 for drilling.

As the example objective functions of Equations (1.1)-(1.3) show, the objective functions in at least some example embodiments comprise multiple parameters, with at least one of those parameters comprising a drilling performance metric such as ROP. Any given objective function may comprise both one or more drilling performance metrics, such as ROP, MSE, and stick-slip severity, and one or more drilling parameters such as differential pressure and WOB.

In parallel with sending the measured WOB and ROP to the objective function 304, the measured WOB is sent to a cross-covariance delay estimator 306 where the processor 212 estimates a WOB perturbation signal delay d between the WOB perturbation signal from block 308 and the measured WOB from the plant 302. The delay is output to block 310, which generates a signal that has the same form as the WOB perturbation signal (in the depicted embodiment, a sine wave of frequency ω) and that is delayed by the delay ("delayed WOB perturbation signal"). The delayed WOB perturbation signal is sent to the correlation coefficient block 312.

At the correlation coefficient block 312, the processor 212 determines the correlation between the delayed WOB perturbation signal from block 310 and the output of the objective function 304. In the depicted embodiment, the processor 212 determines the Pearson correlation coefficient, although in different embodiments (not depicted) a different type of correlation may be used. The processor 212 determines the correlation on samples obtained during a window of time, which is the last $N=TF_s$ samples, where $F_s$ is the sample frequency in Hz and T is the period of the WOB perturbation signal in seconds. Determining the correlation coefficient between the perturbation signal and the output of the objective function on $N=TF_s$ samples results in removing of the DC component and smoothing of the signal. Therefore, the system 300 does not require low pass and high pass filters found in conventional extremum seeking systems.

The processor 212 integrates this correlation using an integrator 314. The integrator 314 comprises a gain scaling coefficient ε that may be empirically determined. Example values for the gain scaling coefficient may vary with the sampling frequency. For example, when the sampling frequency is 5 Hz, the gain scaling coefficient may in certain embodiments be between [0.001,0.01]. The gain scaling coefficient may influence the trade-off between convergence rate to the extremum and relative stability of the target parameters. Lower values of the gain scaling coefficient result in relatively slow convergence but a lower chance of instability, while higher values permit relatively fast convergence but result in a higher chance of instability. The integrator's 314 output is the WOB offset, which is added to the WOB perturbation signal at the adder 316 to generate the WOB target that is fed to the plant 302.

The Pearson correlation coefficient is normalized between [−1,1]. Using a normalized correlation coefficient means that the correlation coefficient is between [−1,1] regardless of the output of the objective function 304, which permits the gain scaling coefficient ε, comprising part of the integrator 314, to remain relatively unchanged regardless of the range of outputs of the objective function 304 and operating conditions. Normalization increases robustness of the method to temporary objective function anomalies such as spikes.

In operation, an initial WOB target is fed to the plant 302. In response to the plant's output to this initial WOB target, the processor 212 determines an updated WOB target as described above and sends the updated WOB target to the plant 302. This process iteratively repeats, with the goal of incrementally increasing the output of the objective function 304 based on the WOB with each iteration.

As the actual ROP is difficult to directly measure, the processor 212 estimates the ROP from the change in the position of the travelling block 108, which is obtained by the drawworks encoder 114*b*. The drill string 118 is sufficiently flexible that changes in WOB cause significant changes in the position of the block 108 due to one or both of drill string stretching and compression. Under certain conditions the magnitude of the block's 108 movement in response to WOB changes due to string stretching or compression is higher than the actual rock penetration. In certain embodiments, it can accordingly be useful account for string stretching and compression as described below.

In the system 300 of FIG. 3, the automated drilling unit 208, and consequently the plant 302, has a delayed, nonlinear response. The measured WOB u'(t) accordingly has the form of Equation (2), which is also the form of a Discrete Fourier Transform:

$$u'(t)=W_{oa}+S_{W1}\sin(\omega(t-d))+S_{W2}\sin(2\omega t)+C_{W2}\cos(2\omega t)+\ldots \quad (2)$$

where $W_{oa}$ is a constant, d is the delay of the measured WOB signal of frequency ω relative to the WOB perturbation signal, $S_{W1}$ is the amplitude of the sine wave having the frequency of the WOB perturbation signal (2ω) and $S_{W2}$ and $C_{W2}$ are amplitudes of the sine and cosine waves having the frequency of the RPM perturbation signal (2ω). Without loss of generality the derivation included here only considers the first two frequencies for clarity, but may be completed for higher order frequencies. For example, in different embodiments (not depicted) in which more than two parameters such as WOB and RPM are used, Equation (2) may be completed for at least as many frequencies are there are parameters in embodiments in which the perturbation signal for each of the parameters is at different frequencies.

Equations (3) and (4) relate the measured ROP y(t) to the measured WOB:

$$y(t) = ROP_{pipe} + ROP_{bit} \quad (3)$$

$$ROP_{pipe} = k\frac{d}{dt}u'(t) \quad (4)$$

where $ROP_{pipe}$ is the contribution to the measured ROP due to stretching or compression of the drill string 108, $ROP_{bit}$ is the ROP at the bit 120, and k is the pipe stretch coefficient, which is inversely proportional to the spring coefficient of the drill string 118.

To compensate for string stretching and compression, $ROP_{pipe}$ is removed from the measured ROP before evaluating the objective function. Substituting the measured WOB from Equation (2) into Equation (4) and taking the derivative results in Equation (5). As with Equation (2) above, without loss of generality the derivation of Equation (5) only considers the first two frequencies for clarity, but may be completed for higher order frequencies.

$$ROP_{pipe}=kS_{W1}\cos(\omega(t-d))+2kS_{W2}\cos(2\omega t)-2kC_{W2}\sin(2\omega t)+\ldots \quad (5)$$

Knowledge of the delay d permits the processor 212 to estimate k. As discussed above, the cross-covariance delay estimator 306 estimates the delay d from the WOB perturbation signal and the measured WOB. Finer time resolution (i.e., better than the resolution of the data samples) may in certain embodiments be achieved using quadratic interpolation.

The processor 212 determines the amplitude of the measured WOB at frequency ω is determined by determining the correlation of the measured WOB with the delayed WOB perturbation signal, as shown in Equation (6). This amplitude is the Fourier coefficient $S_{W1}$ in Equation (2).

$$S_{W1} = \frac{2}{N}\mathrm{corr}(u'(t), \sin(\omega(t-d))) \quad (6)$$

where N is the number of WOB and ROP samples used and, in at least the current example embodiment, the operator corr(X, Y) is determined as the dot-product of the two sequences of numbers, X and Y.

Equation (7) follows from Equation (5):

$$kS_{W1} = \frac{2}{N}\mathrm{corr}(y(t), \cos(\omega(t-d))) \quad (7)$$

At block 320, the processor 212 estimates k by combining Equations (6) and (7):

$$k = \frac{\mathrm{corr}(y(t), \cos(\omega(t-d)))}{\mathrm{corr}(u'(t), \sin(\omega(t-d)))} \quad (8)$$

The processor 212 adjusts the measured ROP for the effects of the 2ω frequency component of the measured WOB by substituting the value of k into Equation (9), which follows from Equation (5):

$$y_{adj}=y(t)-2kS_{W2}\cos(2\omega t)+2kC_{W2}\sin(2\omega t) \quad (9)$$

where $S_{W2}$ and $S_{W2}$ are Fourier coefficients in Equation (2) that the processor 212 can determine using Equations (10) and (11):

$$S_{W2}=\alpha=\frac{2}{N}\mathrm{corr}(u'(t),\sin(2\omega t)) \quad (10)$$

$$C_{W2}=\beta=\frac{2}{N}\mathrm{corr}(u'(t),\cos(2\omega t)) \quad (11)$$

The processor 212 evaluates Equation (10) at block 322, Equation (11) at block 324, and outputs the adjusted ROP $y_{adj}$ at block 330.

Figure 4:
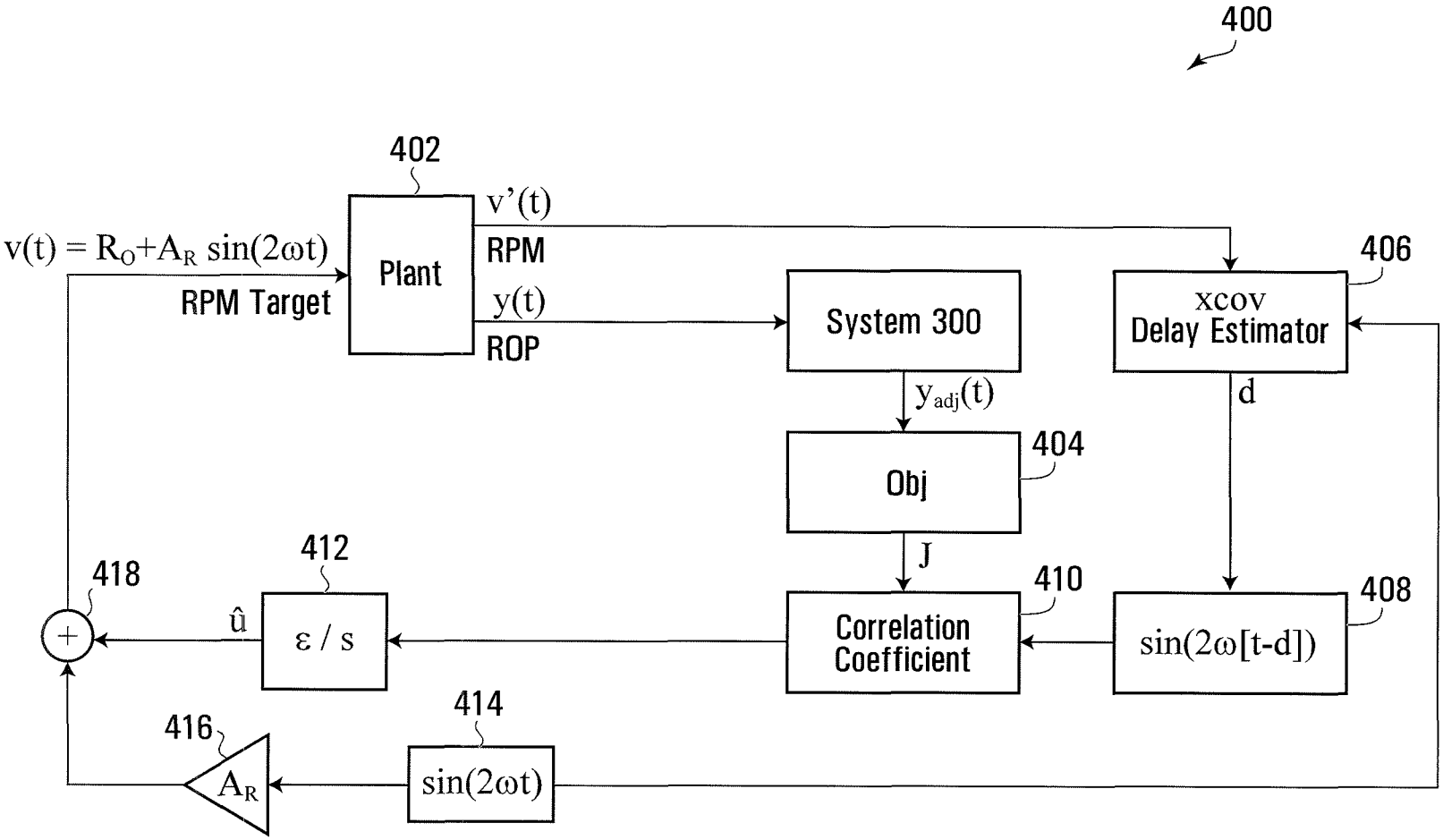
FIG. 4 is a block diagram of a system for seeking an objective function extremum based on rotation rate, according to the embodiment of FIG. 1.

Analogously, the system 400 of FIG. 4 comprises a plant 402 with an unknown response. The plant 402 represents the top drive controller 206 and drilling rig 100. The processor 212 sends the RPM target (v(t)) to the plant 402, and in response the plant 402 outputs the RPM as measured by the RPM sensor 110*b* ("measured RPM") (v'(t)) and the ROP as measured by the drawworks encoder 114*b* (y(t)) to the processor 212.

The RPM target that the processor 212 sends to the plant 402 has the form of Equation (12):

$$v(t)=R_o+A_R\sin(2\omega t) \quad (12)$$

where $R_o$ is an RPM offset and $A_R\sin(2\omega t)$ is an RPM perturbation signal having a perturbation amplitude $A_R$ and angular frequency 2ω.

Selecting the RPM perturbation signal to be twice the frequency of the WOB perturbation signal ensures that the WOB and RPM perturbation signals are orthogonal for the purposes of the systems 300, 400: the correlation calculated on sample sequences W and R over a period of the WOB perturbation signal T equals zero regardless of the phases of the WOB and RPM perturbation signals:

$$W=\text{sequence of } (\sin(\omega t+\theta_1)),\ t=0:1/F_s:(T-1/F_s)$$

$$R=\text{sequence of } (\sin(2\omega t+\theta_2)),\ t=0:1/F_s:(T-1/F_s)$$

$$\mathrm{corr}(W,R)=0\ \forall\theta_1,\theta_2 \quad (3)$$

where $F_s$ is the sample frequency in Hz.

In the depicted embodiments, sample sequences comprise N samples with $N=TF_s$. This ensures that WOB is represented by a sinusoid of frequency ω and RPM is represented by a sinusoid of frequency 2ω in the Discrete Fourier Transform of a sample sequence, as shown in Equation (2) above. Higher frequencies are ignored herein as they are orthogonal to the frequencies of interest.

Blocks 402-418 and 300 in the system 400 of FIG. 4 perform extremum seeking based on the RPM target. More particularly, the processor 212 generates the RPM perturbation signal at blocks 414 and 316, and the RPM perturbation signal is added to the RPM offset at an adder 418 to generate the RPM target. Generating the RPM offset is discussed in further detail below. The RPM target is then sent to the plant 402.

The plant 402 receives the RPM target from the processor 212, from which the processor 212 obtains the measured RPM and ROP using the hookload sensor 202*c* and drawworks encoder 114*b*, respectively. The measured RPM and ROP values are suitably conditioned by, for example, amplification and filtering prior to being used elsewhere in the system 400. The processor 212 uses the measured ROP to generate the adjusted ROP $y_{adj}$ using the system 300 of FIG. 3, as described above. The processor 212 then uses the adjusted ROP to evaluate an objective function 404 of the form provided in Equation (1.1), with the comments above made in respect of the objective function 304 of FIG. 3 also applying to the objective function 404 of FIG. 4. The objective function's 404 output J is sent to a correlation coefficient block 410. While in the depicted embodiment the same objective function is used in both of the systems 300, 400, in different embodiments (not depicted) different objective functions may be used in the systems 300, 400.

In parallel with sending the measured ROP to the system 300 to determine the adjusted ROP, the measured RPM is sent to a cross-covariance delay estimator 406 where the processor 212 estimates a rotation rate perturbation signal delay d between the RPM perturbation signal from block 414 and the measured RPM from the plant 402. The delay is output to block 408, which generates a signal that has the same form as the RPM perturbation signal (in the depicted embodiment, a sine wave of frequency 2ω) and that is delayed by the delay ("delayed RPM perturbation signal"). The delayed RPM perturbation signal is sent to the correlation coefficient block 410.

At the correlation coefficient block 410, the processor 212 determines the correlation between the delayed RPM perturbation signal from block 408 and the output of the objective function 404, in a manner analogous to how the processor 212 makes the analogous determination at block 312 as discussed above. The processor 212 integrates this correlation using an integrator 412, with the gain scaling coefficient ε of the integrator 412 being empirically determined. Example values for the gain scaling coefficient may vary with the sampling frequency. For example, when the sampling frequency is 5 Hz, the gain scaling coefficient may in certain embodiments be between [0.01,0.1]. The gain scaling coefficient may influence the trade-off between convergence rate to the extremum and relative stability of the target parameters. Lower values of the gain scaling coefficient result in relatively slow convergence but a lower chance of instability, while higher values permit relatively fast convergence but result in a higher chance of instability. The integrator's 412 output is the RPM offset, which is added to the RPM perturbation signal at the adder 418 to generate the RPM target that is fed to the plant 402.

In operation, an initial RPM target is fed to the plant 402. In response to the plant's output to this initial RPM target, the processor 212 determines an updated RPM target as described above and sends the updated RPM target to the plant 402. This process iteratively repeats, with the goal of incrementally increasing the objective function based on the RPM with each iteration.

Figure 5:
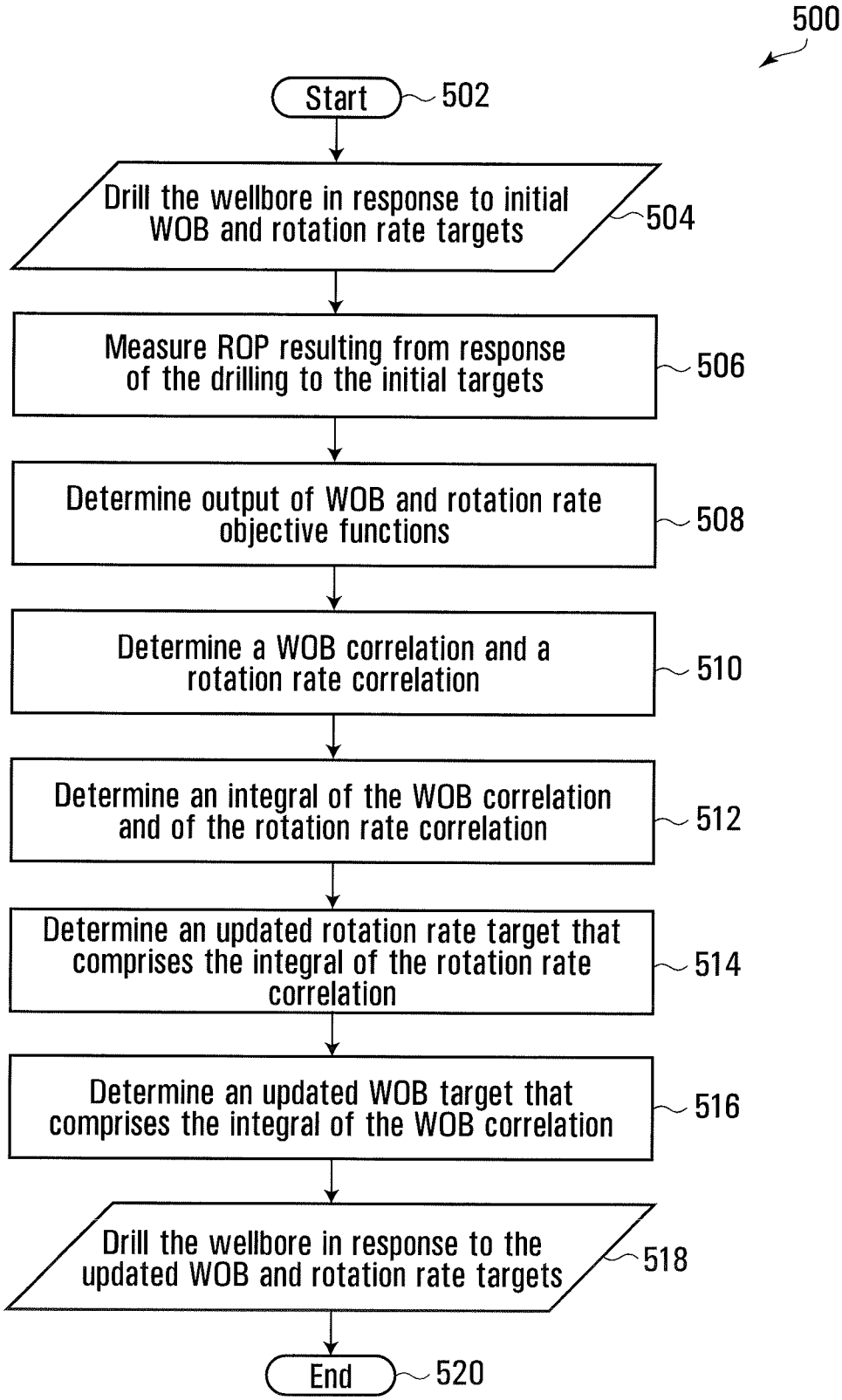
FIG. 5 is a method for performing automated drilling of a wellbore, according to the embodiment of FIG. 1.

Referring now to FIG. 5, there is shown a method 500 for performing automated drilling of the wellbore 116, according to the embodiment of FIG. 1. The method 500 is encoded as computer program code on to the memory 214 and is performed by the processor 214 in conjunction with the top drive controller 206, automated drilling unit 208, top drive 110, drawworks 114, and sensors 202 upon code execution. The processor 212 begins performing the method 500 at block 502 and proceeds to block 504 where it instructs the automated drilling unit 208 and top drive controller 206 to drill the wellbore 118 in response to the initial WOB target and an initial rotation rate target, such as the initial RPM target. Drilling in response to the initial WOB target is described in respect of FIG. 3 above as the input to block 302, and drilling in response to the initial RPM target is described in respect of FIG. 4 above as the input to block 402. As described above in respect of FIGS. 3 and 4, the initial WOB target comprises the initial WOB offset modified by the WOB perturbation signal and the initial RPM target comprises the initial RPM offset, which is an example of an initial rotation rate target, modified by the RPM perturbation signal, which is an example of a rotation rate perturbation signal. The driller may provide starting values for u(t) in FIGS. 3 and 4 for the first iteration of the systems 300, 400.

Following block 504, the processor 212 proceeds to block 506 where it measures the ROP resulting from the response of the drilling to the initial WOB and rotation rate targets. An example of this is the processor 212 in FIGS. 3 and 4 obtaining the ROP y(t) from the plants 302, 402 following their responses to the initial WOB and RPM targets.

Following block 506, the processor 212 proceeds to block 508 where it evaluates the objective functions 304, 404 of the systems 300, 400. In the depicted embodiment, the systems 300, 400 use the same objective function as shown in Equation (1.1). However, in different embodiments (not depicted) the systems 300, 400 may use different objective functions 304, 404.

After evaluating the objective function at block 508, the processor 212 proceeds to block 510 where it determines a WOB correlation between the output of the objective function 304 of FIG. 3 and the WOB perturbation signal and a rotation rate correlation between the output of the objective function 404 of FIG. 4 and the rotation rate perturbation signal. This is described in respect of FIG. 3 above when the processor 212 performs block 312 to determine the correlation between the delayed WOB perturbation signal and the output of the objective function 304, and in respect of FIG. 4 above when the processor 212 performs block 410 to determine the correlation between the delayed RPM perturbation signal and the output of the objective function 404.

The processor 212 at block 512 then determines an integral of the WOB correlation and an integral of the rotation rate correlation. The processor 212 determines the integral of the WOB correlation in FIG. 3 using the integrator 314 and determines the integral of the rotation rate correlation in FIG. 4 using the integrator 412.

In one example embodiment (not depicted), the processor 212 applies a limit check to the outputs of the integrators 314, 412 before using those outputs as inputs to the plants 302, 402. The processor 212 may compare the output of the integrator 314 of FIG. 3 to minimum and maximum WOB limits, while the processor 212 may compare the output of the integrator 412 of FIG. 4 to minimum and maximum RPM limits. If the output of the integrator 314 of FIG. 3 is outside the WOB limits, then the processor 212 clips that output to the minimum or maximum WOB limit as appropriate and uses the clipped output as $W_0$. Similarly, if the output of the integrator 412 of FIG. 4 is outside the RPM limits, then the processor 212 clips that output to the minimum or maximum RPM limit as appropriate and uses the clipped output as $R_0$.

The WOB and RPM limits may be one or both of limits of the absolute value of the outputs of the integrators 314, 412 and limits on the rates of change in those outputs from the last iteration of the systems 300, 400. For example, in one embodiment in which the limit is a limit on rate of change, the minimum and maximum RPM limits may be −5 RPM and +5 RPM relative to the last iterations of the systems 300, 400, respectively. More generally, the limits may be a minimum and a maximum limit expressed as a percentage change such as from the last iteration of the systems 300, 400, a certain minimum or maximum number of absolute units (e.g., maximum of 5 RPM) or relative units (e.g., maximum of +5% relative to the last iteration), or both.

Following integration, the processor 212 at block 514 determines an updated WOB target comprising an updated WOB offset modified by the WOB perturbation signal, with the updated WOB offset comprising the integral of the WOB correlation. The processor 212 does this in FIG. 3 at the adder 316 by summing the updated WOB offset from block 314 with the WOB perturbation signal from block 318.

The processor 212 at block 516 also determines an updated rotation rate target comprising an updated rotation rate offset modified by the rotation rate perturbation signal, with the updated rotation rate offset comprising the integral of the rotation rate correlation. The processor 212 does this in FIG. 4 at the adder 418 by summing the updated RPM offset from block 412 with the RPM perturbation signal from block 416.

At block 518, the processor 212 drills the wellbore 116 in response to the updated WOB target and the updated rotation rate target. This is done in FIG. 3 by sending the updated WOB target to the plant 302, and in FIG. 4 by sending the updated RPM target to the plant 402. In certain embodiments, drilling the wellbore 116 in response to the updated targets may comprise alternating between drilling the wellbore 116 in response to the updated WOB target and drilling the wellbore in response to the updated rotation rate target. At block 520 the specific iteration of the method 500 ends.

In the depicted embodiment, the processor 212 performs a discrete time continuous process that iteratively updates the inputs to the plants 302, 402 at the rate at which data is acquired; that is, the sampling frequency $F_s$. This is in contrast to a conventional automated drilling system in which the system step changes a drilling parameter and waits to get an averaged response from the system 200 before again changing that drilling parameter. In one embodiment, the sampling frequency is 1 Hz, and the period for completing a full perturbance cycle (i.e., a full period of a perturbation signal) is between 90 and 120 seconds.

In different embodiments (not depicted), the processor 212 may iterate at a rate different than the sampling frequency. For example, the processor 212 may iterate at a data update frequency, which is the frequency at which one or both of the top drive controller 206 and the automated drilling unit 208 update the top drive PLC 110*a* and drawworks PLC 114*a*, respectively. In one example embodiment, the sampling frequency is 1 Hz and the data update frequency is 5 Hz.

Example 1

Figure 6A:
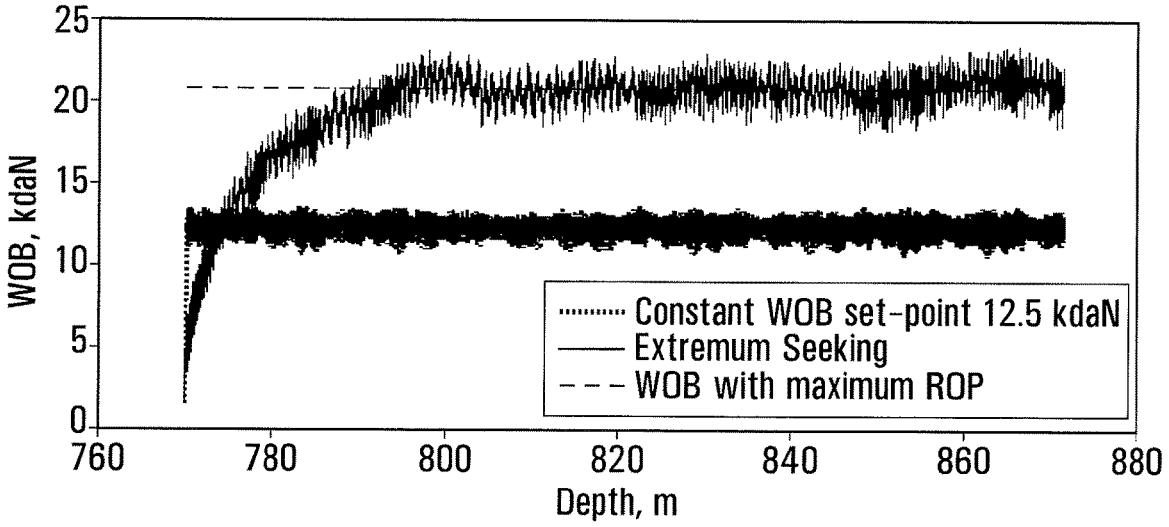
FIGS. 6A, 6B, and 6C depict 2D plots of WOB, revolutions per minute ("RPM"), and rate of penetration ("ROP"), respectively, versus drilling depth, according to one example embodiment.
Figure 6B:
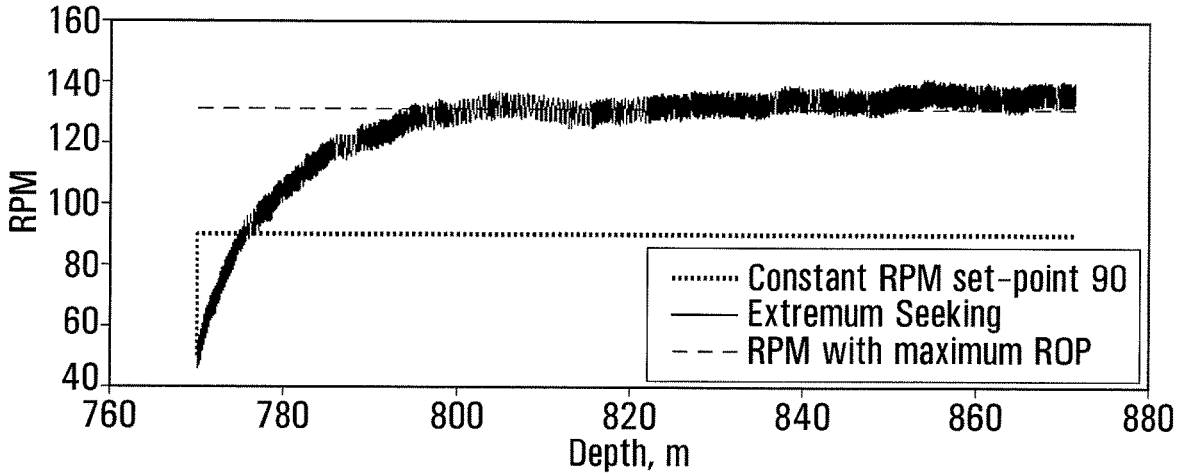
Figure 6C:
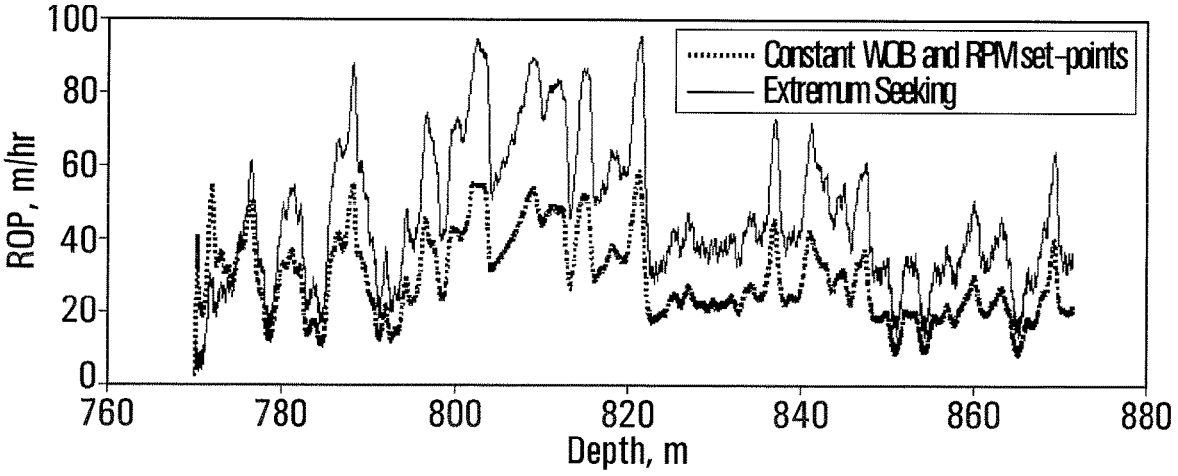

Referring now to FIGS. 6A, 6B, and 6C, there are depicted 2D plots of WOB, RPM, and ROP, respectively, versus drilling depth, according to one example embodiment in which the output of the objective functions 304,404 is set equal to ROP.

The long dashed line in FIG. 6A represents theoretical actual WOB at maximum ROP. The short dashed line in FIG. 6A represents measured WOB when the automated drilling unit 208 is set to maintain a constant WOB of 12.5 kdaN. The solid line in FIG. 6A represents measured WOB when applying the system 200 with the initial set point for WOB at 5 kdaN and for RPM at 50. The plot of FIG. 6A shows measured WOB when the system 200 is applied converging to the WOB corresponding to maximum ROP.

The long dashed line in FIG. 6B represents theoretical actual RPM at maximum ROP. The short dashed line in FIG. 6B represents measured RPM when the top drive controller 206 is set to maintain a constant rotation rate of 90 RPM. The solid line in FIG. 6B represents measured RPM when applying the system 200 with the initial set point for WOB at 5 kdaN and for RPM at 50. The plot of FIG. 6B shows measured RPM when the system 200 is applied converging to the RPM corresponding to maximum ROP.

The dashed line in FIG. 6C shows measured ROP when the automated drilling unit 208 is set to maintain a constant WOB of 12.5 kdaN and the top drive controller 206 is set to maintain a constant rotation rate of 90 RPM. The solid line of FIG. 6C shows measured ROP when the system 200 is applied with the initial set point for WOB at 5 kdaN and for RPM at 50. ROP on average is materially higher when the system 200 is applied compared to when constant RPM and WOB set points are used.

Figure 7A:
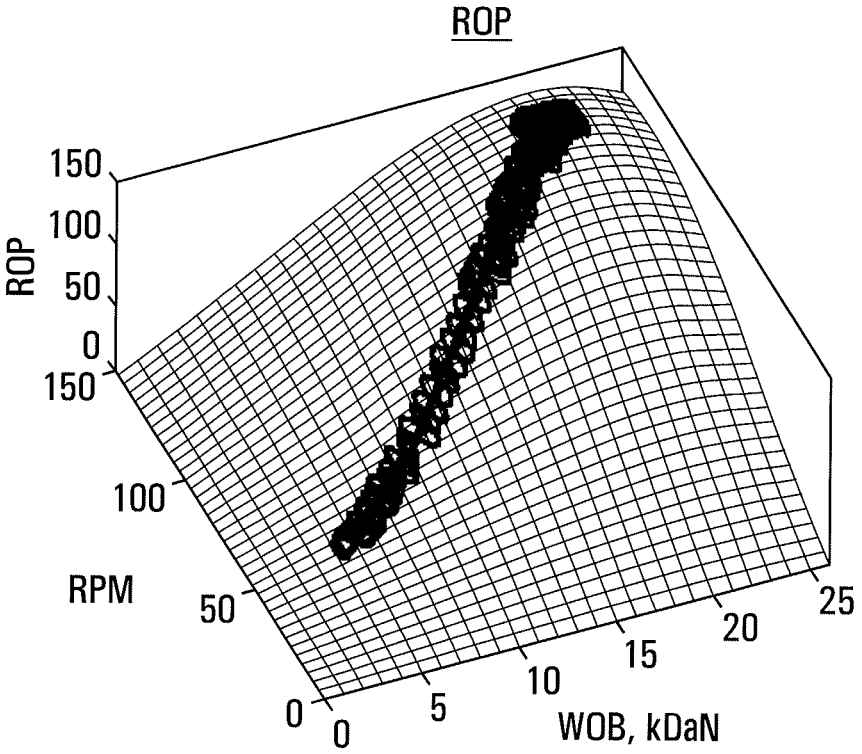
FIGS. 7A and 7B depict 3D plots of ROP and mechanical specific energy ("MSE"), respectively, versus RPM and WOB, according to the example embodiment of FIGS. 6A-C.
Figure 7B:
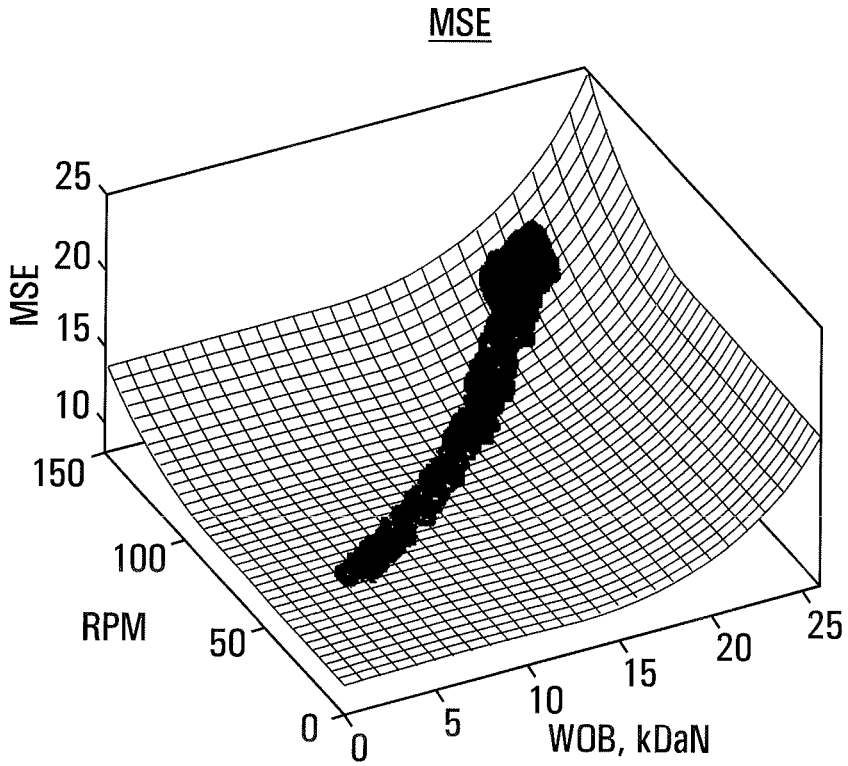

FIGS. 7A and 7B depict 3D plots of ROP and MSE, respectively, versus RPM and WOB, according to the example embodiment of FIGS. 6A-C. ROP and MSE are shown in relative units. The ROP and MSE values followed by the system 200 until convergence are shown.

Example 2

Figure 8A:
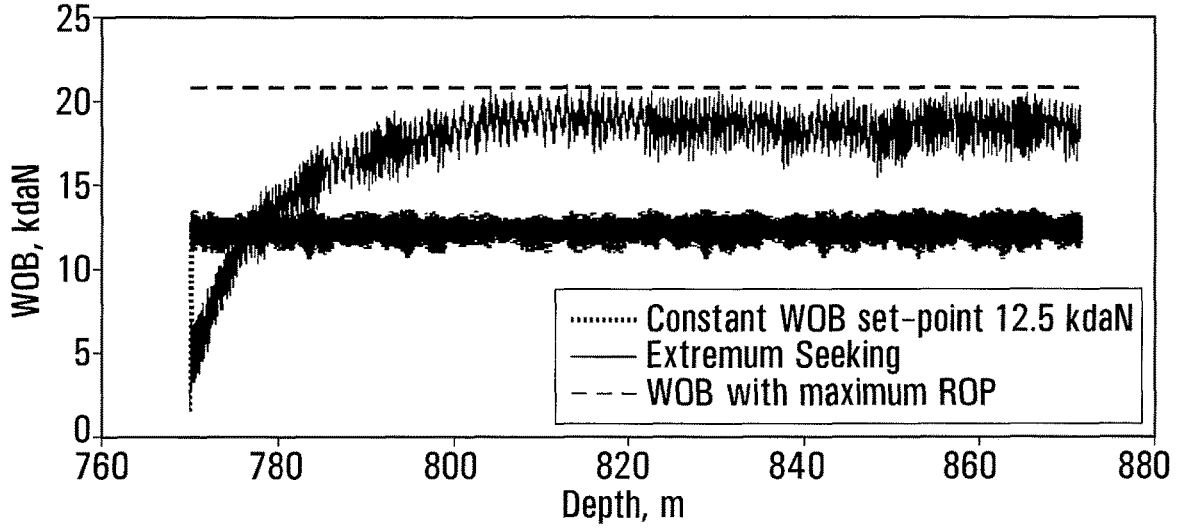
FIGS. 8A, 8B, and 8C depict 2D plots of WOB, RPM, and ROP, respectively, versus drilling depth, according to another example embodiment.
Figure 8B:
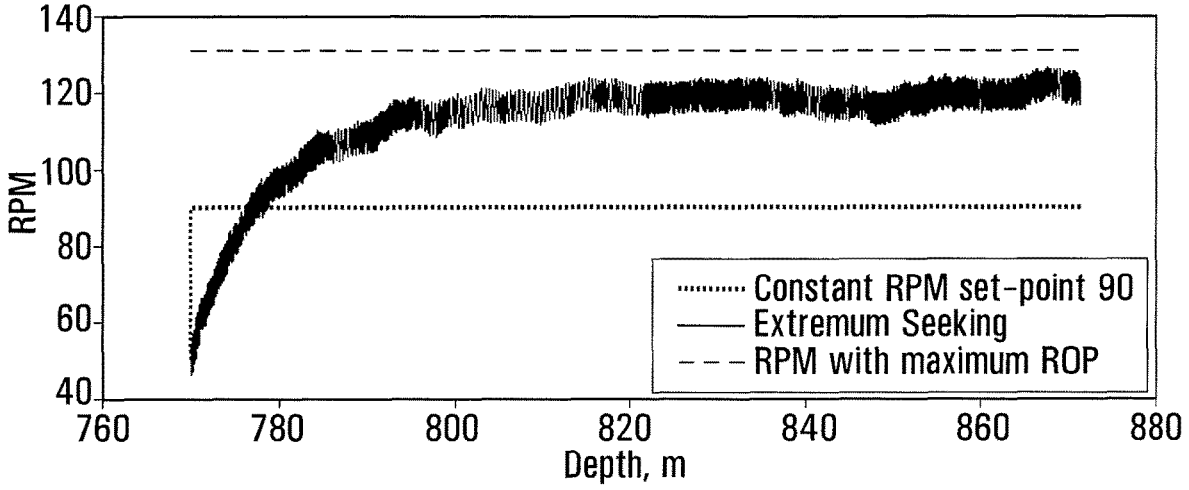
Figure 8C:
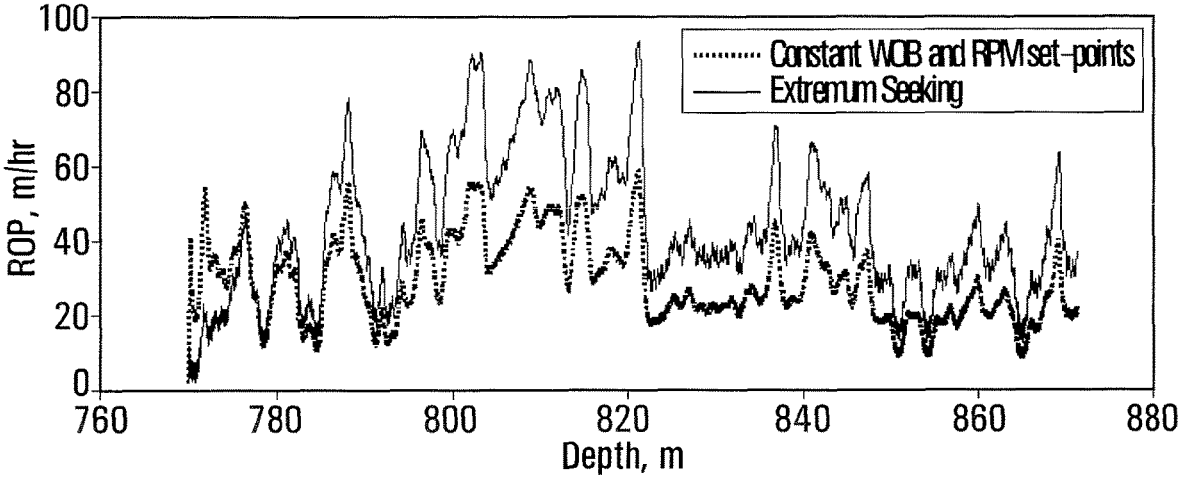

Referring now to FIGS. 8A, 8B, and 8C, there are depicted 2D plots of WOB, RPM, and ROP, respectively, versus drilling depth, according to one example embodiment in which the output of the objective functions 304, 404 is set equal to $(ROP^2)/(T^{0.8}RPM^{0.8})$, where T is torque applied by the top drive 110.

The long dashed line in FIG. 8A represents the theoretical actual WOB which, combined with the theoretical actual RPM, permits determination of the theoretical maximum ROP. The short dashed line in FIG. 8A represents measured WOB when the automated drilling unit 208 is set to maintain a constant WOB of 12.5 kdaN. The solid line in FIG. 8A represents measured WOB when applying the system 200 with the initial set point for WOB at 5 kdaN and for RPM at 50. The plot of FIG. 8A shows measured WOB when the system 200 is applied converging to the WOB corresponding to maximum objective function value.

The long dashed line in FIG. 8B represents theoretical actual RPM at maximum ROP. The short dashed line in FIG. 8B represents measured RPM when the top drive controller 206 is set to maintain a constant rotation rate of 90 RPM. The solid line in FIG. 8B represents measured RPM when applying the system 200 with the initial set point for WOB at 5 kdaN and for RPM at 50. The plot of FIG. 8B shows measured RPM when the system 200 is applied converging to the RPM corresponding to maximum objective function value.

The dashed line in FIG. 8C shows measured ROP when the automated drilling unit 208 is set to maintain a constant WOB of 12.5 kdaN and the top drive controller 206 is set to maintain a constant rotation rate of 90 RPM. The solid line of FIG. 8C shows measured ROP when the system 200 is applied with the initial set point for WOB at 5 kdaN and for RPM at 50. ROP on average is materially higher when the system 200 is applied compared to when constant RPM and WOB set points are used.

Figure 9A:
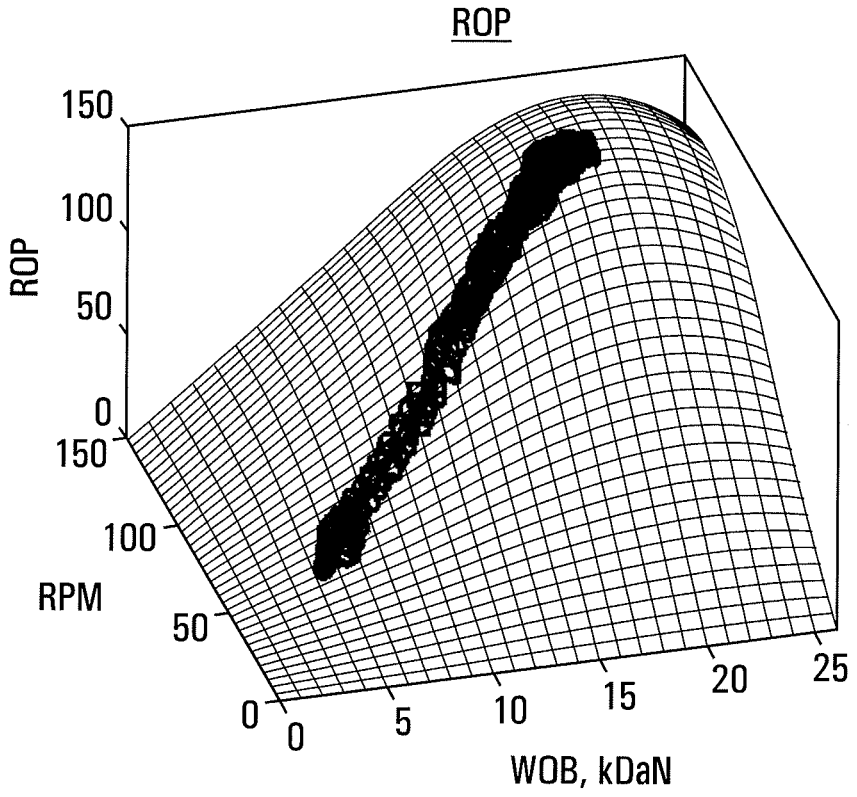
FIGS. 9A and 9B depict 3D plots of ROP and MSE, respectively, versus RPM and WOB, according to the example embodiment of FIGS. 8A-C.
Figure 9B:
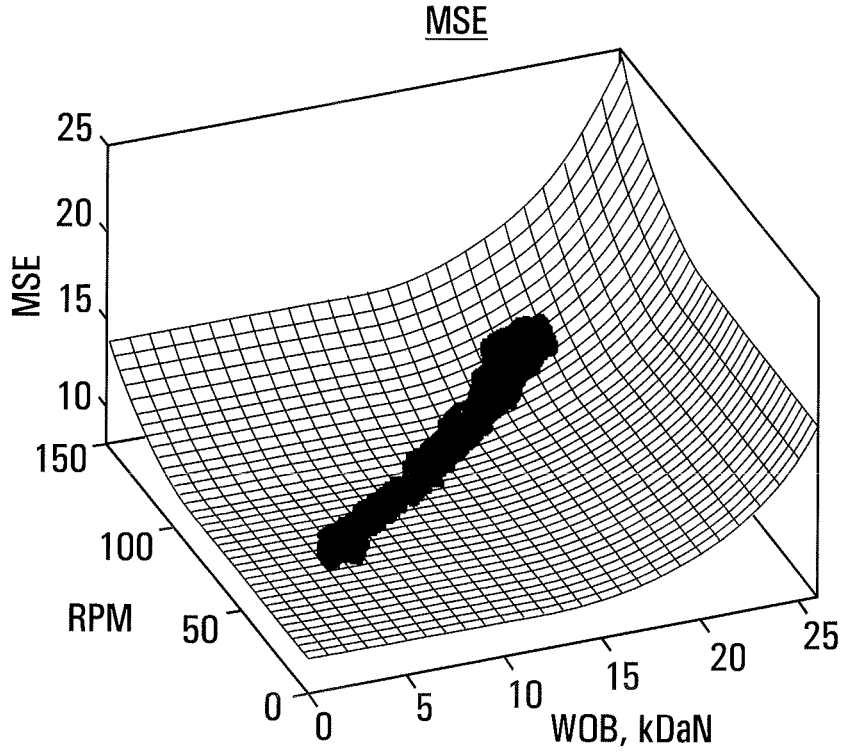

FIGS. 9A and 9B depict 3D plots of ROP and MSE, respectively, versus RPM and WOB, according to the example embodiment of FIGS. 8A-C. ROP and MSE are shown in relative units. The ROP and MSE values followed by the system 200 until convergence to the maximum of the objective function of Equation (1.1), with a=b=0.8 and c=2.

While particular embodiments have been described in the foregoing, it is to be understood that other embodiments are possible and are intended to be included herein. It will be clear to any person skilled in the art that modifications of and adjustments to the foregoing embodiments, not shown, are possible.

For example, while in the depicted embodiments each of the WOB and rotation rate perturbation signals are sinusoidal (e.g., sine and cosine signals), in different embodiments (not depicted), they need not be. Example alternative types of perturbation signals comprise square or triangular waves. Similarly, while in the depicted embodiments the rotation rate perturbation signal has a frequency twice that of the WOB perturbation signal, in different embodiments (not depicted) the frequencies of the perturbation signals may be different. For example, in one different embodiment (not depicted) the WOB and rotation rate perturbation signals may be identical, in which case the processor 212 alternates between the use of WOB and rotation rate as the means of achieving the extremum of the specified objective function. In certain embodiments, the WOB perturbation signal has a frequency lower than that of the rotation rate perturbation signal, which reflects the relatively high responsiveness of rotation rate control in response to signals from the top drive PLC 110*b* when compared to the responsiveness of WOB in response to signals from the drawworks PLC 114*a*.

As another example, while in the depicted embodiment two drilling parameters (WOB and rotation rate) are used as inputs to the plants 302, 402, in different embodiments more than two drilling parameters may be used as inputs, with each drilling parameter having its own perturbation signal. In certain embodiments the perturbation signal for each drilling parameter has a frequency different than the other drilling parameters. Furthermore, in certain embodiments one or more drilling parameters may be subject to an estimation and adjustment for delay, or other dynamic behavior, specific to those parameters; for example, when differential pressure is the drilling parameter in question, a lag correction factor may be applied.

In at least some different embodiments (not depicted), more than two signals may be dithered. Each additional signal may be dithered using a dither frequency specific to that signal.

As another example, while the drilling rig 100 in the depicted embodiments is capable of performing directional drilling by virtue of the bent sub 130 and mud motor 132, in different embodiments (not depicted) the drilling rig 100 may lack one or both of the bent sub 130 and motor 132.

As another example, in the depicted embodiments the drawworks 114 is used to raise and lower the drill string 118. In different embodiments (not depicted), a different height control apparatus for raising or lowering the drill string 118 may be used. For example, hydraulics may be used for raising and lowering the drill string 118. In embodiments in which hydraulics are used, the traveling block 108 may be omitted and consequently the processor 212 does not use the height of the block 108 as a proxy for drill string height, as it does in the depicted embodiments. In those embodiments, the processor 212 may use output from a different type of height sensor to determine drill string position and ROP. For example, the motion of the traveling block 108 may be translated into rotary motion and rotary motion encoder may then be used to digitize readings of that motion. This may be done using a roller that runs along a rail or, if crown sheaves are present, the encoder may be installed on the sheaves' axel. Various gears may also be present as desired. As additional examples, laser based motion measurements may be taken, a machine vision based measurement system may be used, or both.

As another example, in different embodiments (not depicted), other objective functions than those described above may be used. For example, in one of these embodiments the objective function may consider any one or more of mud flow rate, which affects rotation of the mud motor 132; torque applied to the drill string 118, which may be measured using a sensor on the top drive 110; standpipe pressure as determined using the standpipe pressure sensor 202*d*, which may be used to determine mud motor differential pressure and consequently downhole torque in embodiments in which the mud motor 132 is active; and a parameter that represents whether energy is being used efficiently, such as mechanical specific energy. In another non-depicted example embodiment, the objective function may comprise a target setpoint (e.g., target depth of cut, where depth of cut=ROP/RPM), and the processor 212 may attempt to adjust drilling so that the target setpoint is approached or achieved.

While a single processor 212 is depicted in FIG. 2, in different embodiments (not depicted) the processor 212 may comprise multiple processors, one or more microprocessors, or a combination thereof. Similarly, in different embodiments (not depicted) the single memory 214 may comprise multiple memories. Any one or more of those memories may comprise, for example, mass memory storage, ROM, RAM, hard disk drives, optical disk drives (including CD and DVD drives), magnetic disk drives, magnetic tape drives (including LTO, DLT, DAT and DCC), flash drives, removable memory chips such as EPROM or PROM, or similar storage media as known in the art.

In different embodiments (not depicted), the computer 210 may also comprise other components for allowing computer programs or other instructions to be loaded. Those components may comprise, for example, a communications interface that allows software and data to be transferred between the computer 210 and external systems and networks. Examples of the communications interface comprise a modem, a network interface such as an Ethernet card, a wireless communication interface, or a serial or parallel communications port. Software and data transferred via the communications interface are in the form of signals which can be electronic, acoustic, electromagnetic, optical, or other signals capable of being received by the communications interface. The computer 210 may comprise multiple interfaces.

In certain embodiments (not depicted), input to and output from the computer 210 is administered by an input/output (I/O) interface. In these embodiments the computer 210 may further comprise a display and input devices in the form, for example, of a keyboard and mouse. The I/O interface administers control of the display, keyboard, and mouse. In certain additional embodiments (not depicted), the computer 210 also comprises a graphical processing unit. The graphical processing unit may also be used for computational purposes as an adjunct to, or instead of, the processor 210.

In all embodiments, the various components of the computer 210 may be communicatively coupled to one another either directly or indirectly by shared coupling to one or more suitable buses.

Directional terms such as "top", "bottom", "up", "down", "front", and "back" are used in this disclosure for the purpose of providing relative reference only, and are not intended to suggest any limitations on how any article is to be positioned during use, or to be mounted in an assembly or relative to an environment. The term "couple" and similar terms, and variants of them, as used in this disclosure are intended to include indirect and direct coupling unless otherwise indicated. For example, if a first component is communicatively coupled to a second component, those components may communicate directly with each other or indirectly via another component. Additionally, the singular forms "a", "an", and "the" as used in this disclosure are intended to include the plural forms as well, unless the context clearly indicates otherwise.

The word "approximately" as used in this description in conjunction with a number or metric means within 5% of that number or metric.

It is contemplated that any feature of any aspect or embodiment discussed in this specification can be implemented or combined with any feature of any other aspect or embodiment discussed in this specification, except where those features have been explicitly described as mutually exclusive alternatives.

The invention claimed is:

1. A method for performing automated drilling of a wellbore, the method comprising:

(a) drilling the wellbore in response to a first drilling parameter target, wherein the first drilling parameter target comprises a first drilling parameter offset modified by a first drilling parameter perturbation signal;

(b) performing a measurement to obtain a first drilling performance metric that is indicative of a response of the drilling to the first drilling parameter target;

(c) determining an output of a first objective function using the first drilling performance metric;

(d) using the output of the first objective function and the first drilling parameter perturbation signal to update the first drilling parameter target; and (e) after the first drilling parameter target has been updated, drilling the wellbore in response to the first drilling parameter target.

2. The method of claim 1, wherein (d) comprises:

determining a first correlation between the output of the first objective function and the first drilling parameter perturbation signal; and updating the first drilling parameter target using the first correlation modified by the first drilling parameter perturbation signal.

3. The method of claim 2 wherein determining the first correlation comprises:

(a) measuring the response of the automated drilling to the first drilling parameter target to determine a measured first drilling parameter;

(b) determining a first drilling parameter perturbation signal delay from a correlation between the first drilling parameter perturbation signal and the measured first drilling parameter; and (c) delaying the first drilling parameter perturbation signal by the first drilling parameter perturbation signal delay prior to using the first drilling parameter perturbation signal to determine the first correlation.

4. The method of claim 1 wherein (a)-(e) are iteratively performed at a sampling frequency used to measure the first drilling performance metric.

5. The method of claim 1 further comprising:

(a) drilling the wellbore in response to a second drilling parameter target, wherein the second drilling parameter target comprises a second drilling parameter offset modified by a second drilling parameter perturbation signal;

(b) performing a measurement to obtain a second drilling performance metric that is indicative of a response of the drilling to the second drilling parameter target;

(c) determining an output of a second objective function using the second drilling performance metric;

(d) using the output of the second objective function and the second drilling parameter perturbation signal to update the second drilling parameter target; and (e) after the second drilling parameter target has been updated, drilling the wellbore in response to the second drilling parameter target.

6. The method of claim 5, wherein (d) comprises:

determining a second correlation between the output of the second objective function and the second drilling parameter perturbation signal; and updating the second drilling parameter target using the second correlation modified by the second drilling parameter perturbation signal.

7. The method of claim 6 wherein determining the second correlation comprises:

(a) measuring the response of the automated drilling to the second drilling parameter target to determine a measured second drilling parameter;

(b) determining a second drilling parameter perturbation signal delay from a correlation between the second drilling parameter perturbation signal and the measured second drilling parameter; and (c) delaying the second drilling parameter perturbation signal by the second drilling parameter perturbation signal delay prior to using the second drilling parameter perturbation signal to determine the second correlation.

8. The method of claim 6 wherein:

(a) updating the first drilling parameter target comprises determining an integral of the first correlation, comprising:

(i) applying a limit check to the integral of the first correlation;

(ii) when the integral of the first correlation is less than a minimum first parameter limit, updating the first drilling parameter target using the minimum first parameter limit; and (iii) when the integral of the first correlation exceeds a maximum first parameter limit, updating the first drilling parameter target using the maximum first parameter limit; and (b) updating the second drilling parameter target comprises determining an integral of the second correlation, comprising:

(i) applying a limit check to the integral of the second correlation;

(ii) when the integral of the second correlation is less than a minimum second parameter limit, updating the second drilling parameter target using the minimum second parameter limit; and (iii) when the integral of the second correlation exceeds a maximum second parameter limit, updating the second drilling parameter target using the maximum second parameter limit.

9. The method of claim 6 wherein each of the first and second drilling performance metrics is rate of penetration and further comprising, prior to determining the second correlation, removing from the second drilling performance metric a portion of the rate of penetration attributed to stretching and compression of a drill string used to drill the wellbore.

10. The method of claim 9 wherein the measured first drilling parameter comprises a non-linear and delayed response to the first drilling parameter target, and further comprising determining the portion of the second drilling performance metric attributed to stretching and compression of the drill string from the measured first drilling parameter and the second drilling performance metric.

11. The method of claim 9 wherein each of the first and second objective functions is $$J = \frac{ROP^c}{T^a N^b},$$

wherein J is the output of the first and second objective functions, ROP is the rate of penetration, T is torque applied to the drill string, and N is revolutions per minute of a drill bit used to drill the wellbore.

12. The method of claim 5 wherein (a)-(e) of claim 5 are iteratively performed at a sampling frequency used to measure the second drilling performance metric.

13. The method of claim 5 wherein the first drilling performance metric is rate of penetration, mechanical specific energy, or stick-slip severity, and the second drilling performance metric is rate of penetration, mechanical specific energy, or stick-slip severity.

14. The method of claim 5 wherein the first and second objective functions are identical.

15. The method of claim 5 wherein each of the first and second drilling parameter perturbation signals is sinusoidal.

16. The method of claim 5 wherein the first drilling parameter is weight-on-bit, the first drilling parameter target is a weight-on-bit target, the second drilling parameter is rotation rate, and the second drilling parameter target is a rotation rate target.

17. The method of claim 1 wherein the first objective function is $$J = \frac{ROP^c}{WOB^a N^b},$$

wherein J is the output of the first objective function, ROP is the rate of penetration, WOB is weight-on-bit, and N is revolutions per minute of a drill bit used to drill the wellbore.

18. The method of claim 1 wherein the first objective function is $$J = \frac{ROP^c}{DIFP^a N^b},$$

wherein J is the output of the first objective function, ROP is the rate of penetration, DIFP is differential pressure, and N is revolutions per minute of a drill bit used to drill the wellbore.

19. A system for performing automated drilling of a wellbore, the system comprising:

(a) a height control apparatus configured to adjust a height of a drill string used to drill the wellbore;

(b) a height sensor;

(c) a rotational drive unit comprising a rotational drive unit controller and a rotation rate sensor;

(d) a depth sensor;

(e) a hookload sensor;

(f) a drilling controller communicatively coupled to the rotational drive unit controller, the rotation rate sensor, the height control apparatus, the height sensor, the depth sensor, and the hookload sensor, the drilling controller configured to perform a method comprising:

(i) drilling the wellbore in response to a first drilling parameter target, wherein the first drilling parameter target comprises a first drilling parameter offset modified by a first drilling parameter perturbation signal;

(ii) performing a measurement to obtain a first drilling performance metric that is indicative of a response of the drilling to the first drilling parameter target;

(iii) determining an output of a first objective function using the first drilling performance metric;

(iv) using the output of the first objective function and the first drilling parameter perturbation signal to update the first drilling parameter target; and (v) after the first drilling parameter target has been updated, drilling the wellbore in response to the first drilling parameter target.

20. A non-transitory computer readable medium having stored thereon program code that is executable by a processor and that, when executed, causes the processor to perform a method comprising:

(a) drilling a wellbore in response to a first drilling parameter target, wherein the first drilling parameter target comprises a first drilling parameter offset modified by a first drilling parameter perturbation signal;

(b) performing a measurement to obtain a first drilling performance metric that is indicative of a response of the drilling to the first drilling parameter target;

(c) determining an output of a first objective function using the first drilling performance metric;

(d) using the output of the first objective function and the first drilling parameter perturbation signal to update the first drilling parameter target; and (e) after the first drilling parameter target has been updated, drilling the wellbore in response to the first drilling parameter target.

* * * * *